US007077761B2

(12) United States Patent
Nishio

(10) Patent No.: US 7,077,761 B2
(45) Date of Patent: Jul. 18, 2006

(54) GOLF CLUB AND METHOD OF MAKING GOLF CLUB

(75) Inventor: Masayoshi Nishio, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/645,559

(22) Filed: Aug. 22, 2003

(65) Prior Publication Data

US 2004/0048681 A1 Mar. 11, 2004

(30) Foreign Application Priority Data

Aug. 23, 2002 (JP) ..... 2002-243980

(51) Int. Cl.
*A63B 53/04* (2006.01)
*A63B 53/10* (2006.01)

(52) U.S. Cl. ..... 473/314; 473/319; 473/345

(58) Field of Classification Search ..... 473/311, 473/345–346, 282, 316–323, 314
See application file for complete search history.

(56) References Cited

U.S. PATENT DOCUMENTS 5,093,162 A * 3/1992 Fenton et al. ..... 428/34.5
5,348,777 A * 9/1994 Oonuki et al. ..... 428/34.5
5,429,357 A * 7/1995 Kobayashi ..... 473/311
6,213,888 B1 * 4/2001 Kawaguchi et al. ..... 473/223

FOREIGN PATENT DOCUMENTS

JP 2001-286585 * 10/2001

* cited by examiner

*Primary Examiner*—Stephen Blau
(74) *Attorney, Agent, or Firm*—Birch, Stewart, Kolasch and Birch, LLP

(57) ABSTRACT

A wood-type golf club including a club shaft and a club head, wherein the club length is in a range of from 43 to 48 inches, the volume of the club head is in a range of not less than 250 cc, and the torque T in degree of the club shaft and the gravity point distance L in mm between the gravity point of the club head and the center line of the club shaft satisfy conditions (1) $T \geqq 0.143L-2.79$ and (2) $T \leqq 0.286L-7.14$.

9 Claims, 7 Drawing Sheets

GOLF CLUB AND METHOD OF MAKING GOLF CLUB

BACKGROUND OF THE INVENTION

The present invention relates to a golf club and more particularly to a wood-type golf club having a specific relationship between the gravity point of its relatively large-sized club head and the torsional rigidity of the club shaft by which the head rebounds fully at impact.

In recent years, metal wood-type golf clubs having a head volume over 250 cc are widely used.

AS the increasing in the head volume leads the club head to a large moment of inertia, even if the golfer makes a miss shot off the sweet spot, the movement or reaction of the club head at impact becomes less, and the deterioration in the directional stability of hitting and loss of carry may be reduced. Therefore, large-sized golf club heads are preferred by many golfers, and the head volume is increasing and now reaches to 400 cc or more.

However, when the size of the club head is increased, the distance of the gravity point from the center line of the club shaft is basically increased. During the downswing, the club head is subjected to a force to rotate the club head around the club shaft center line. This force increases substantially in proportion to the increase in the gravity point distance. Therefore, in the case of a club head whose gravity point distance is long, as shown in FIG. 8, which shows the head motion during the downswing from a moment proximate to impact to impact, the club face is likely not to fully rebound to a state of being square at impact. As a result, there is a tendency to slice a shot or to miss a shot towards a different direction B (a right direction B in the case of the right-handed golfer) than the direction A of the target trajectory. Such a tendency is especially high in the case of average golfers.

As a countermeasure for preventing such a miss shot, it has been known to provide a club face having a relatively large hook angle (or face angle). This method is premised on the fact that the club face does not rebound completely to a normal state where the club face becomes square. Thus, this is not a fundamental solution. Further, if the hook angle becomes large, it becomes difficult to address or feel odd.

SUMMARY OF THE INVENTION

A primary object of the present invention is therefore, to provide a golf club, in which the fundamental problem, that is, where the club head does not rebound completely at impact, is solved without providing a large hook angle, and thus golfers may avoid the problems of a sliced shot and missed shot.

Another object of the present invention is to provide a method of making a wood-type golf club which can provide an optimized combination of a club shaft and a club head, especially a large-sized club head.

According to one aspect of the present invention, the wood-type golf club comprises a club shaft and a club head attached to an end of the club shaft, wherein the club length is in a range of from 43 to 48 inches, the volume of the club head is in a range of not less than 250 cc, and the torque T in degree of the club shaft and the gravity point distance L in mm between the gravity point of the club head and the center line of the club shaft satisfy the conditions (1) $T \geqq 0.143L-2.79$ and (2) $T \leqq 0.286L-7.14$.

According to another aspect of the present invention, a method of making the golf club comprises measuring torque T in degree of the club shaft, measuring a gravity point distance L in mm of the club head, examining whether the torque T and gravity point distance L satisfy the conditions (1) $T \geqq 0.143L-2.79$ and (2) $T \leqq 0.286L-7.14$, and assembling the club shaft and club head when their torque T and gravity point distance L satisfy the conditions (1) and (2).

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Embodiments of the present invention will now be described in detail in conjunction with the accompanying drawings.

Definitions

Figure 1:
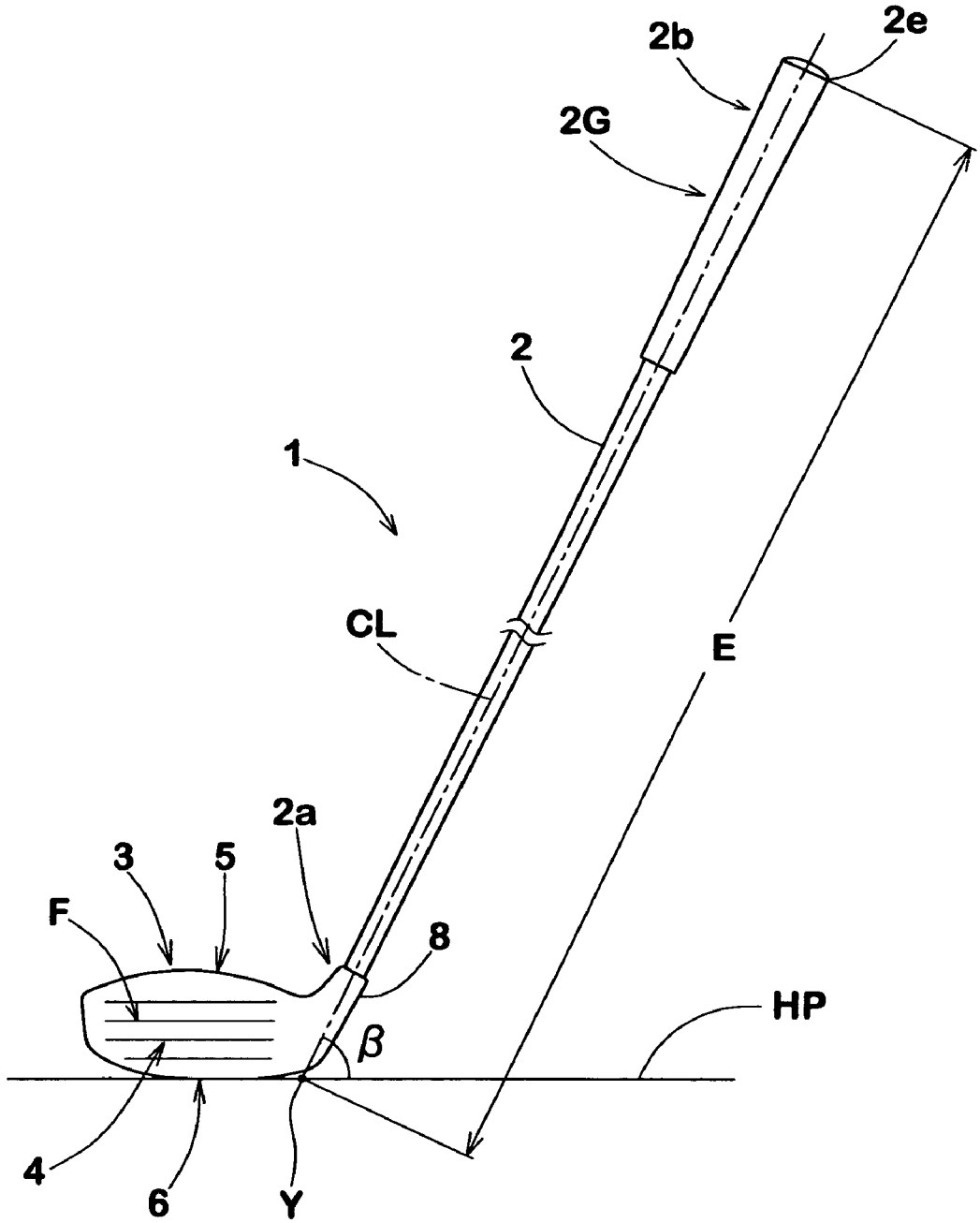
FIG. 1 is a front view of a golf club according to the present invention.
Figure 2:
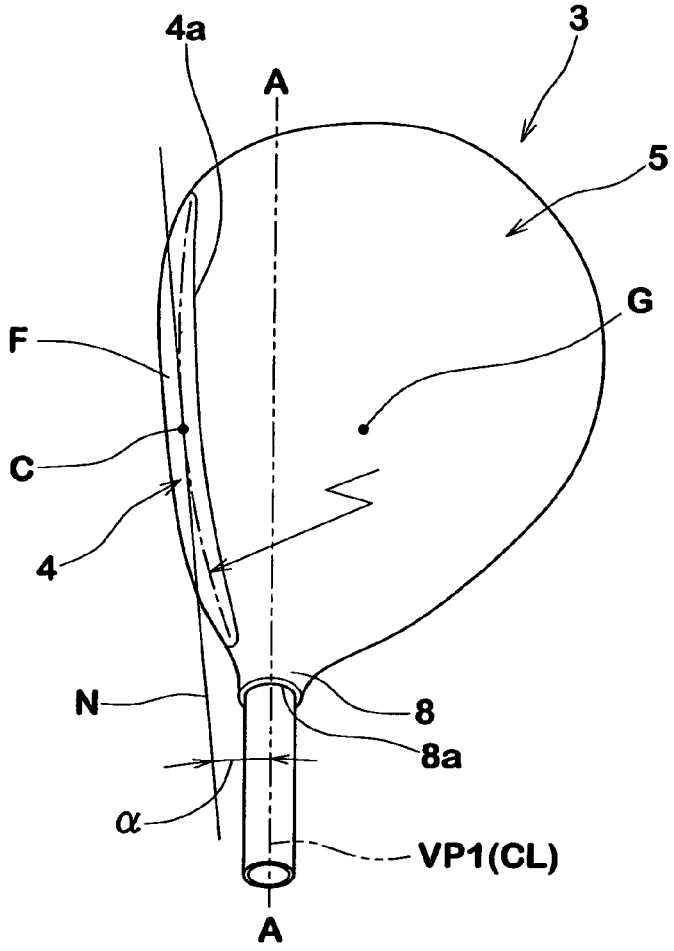
FIG. 2 is a top view of the club head thereof.

"Club length" is, as shown in FIG. 1 and FIG. 2, defined as the length E measured along the shaft center line CL from the end 2*e* of the grip 2G to the intersecting point Y of the center line CL of the shaft 2 and the undermentioned horizontal plane HP under the measuring state. Here, the measuring state is that the club head 3 is placed on the horizontal plane HP so that the shaft center line CL inclines at the lie angle β, while keeping the center line CL within a vertical plane VP1, and the club face F forms the hook angle α with respect to the vertical plane VP1. When the club face F is slightly curved, the hook angle α is defined as an angle between a horizontal line N tangent to the sweet spot C on the club face F and the vertical plane VP1. Here, the sweet spot c is the point of intersection between the club face F and a straight line drawn normally to the club face F passing the gravity point G of the club head.

Figure 4:
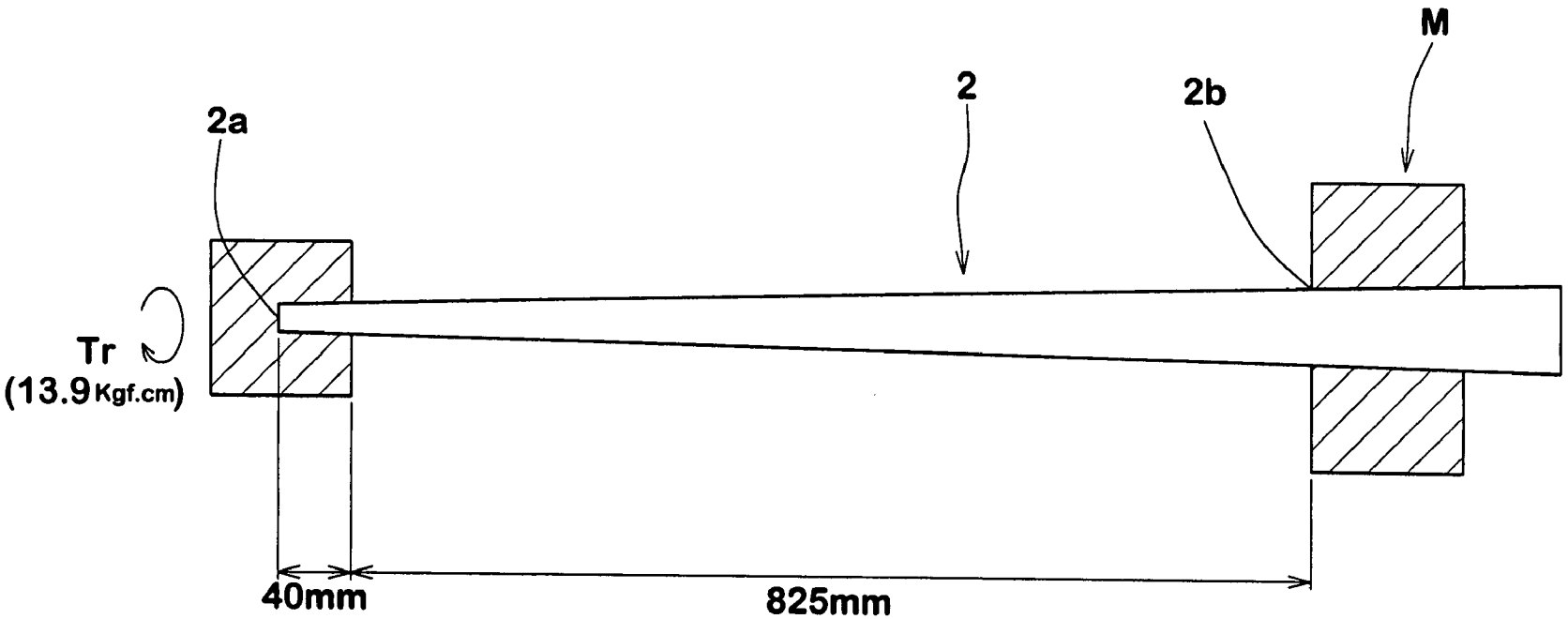
FIG. 4 is a diagram for explaining the torque T of the club shaft and a measuring method therefor.

"Torque" of the club shaft 2 is, as shown in FIG. 4, defined as the twist angle (degrees) of the shaft measured at a position at 40 mm from the end 2*a* (club head side) of the shaft 2 when a torque Tr of 13.9 kgf·cm is applied to the 40 mm position, with a position at 40 mm+825 mm from the end 2*a* being fixed immovably in any direction with a holder M.

"Gravity point distance" of the club head 3 is the shortest distance L from the gravity point G to the shaft center line CL.

According to the present invention, a wood-type golf club 1 comprises a club shaft 2 with a grip 2G and a club head 3 attached to the end 2*a* of the club shaft 2.

Here, the "wood-type golf club" means at least from number 1 wood through to number 5 wood.

The club length E of the club 1 is set in the range of from 43 to 48 inches, preferably 43 to 47 inches, more preferably 43 to 46 inches.

The club head 3 is a hollow-center metal head comprising a face portion 4 whose front face defines a club face F for striking a ball, a crown portion 5 intersecting the club face F at the upper edge 4*a* thereof, a sole portion 6 intersecting the club face F at the lower edge thereof, a side portion 7 between the crown portion 5 and sole portion 6 which extends from a toe-side edge to a heel-side edge of the club face F through the back face of the club head, and a neck portion 8 attached to the end 2*a* of the club shaft 2.

The volume of the club head 3 is set in the range of not less than 250 cc, preferably 270 to 500 cc, more preferably 300 to 500 cc, still more preferably 320 to 480 cc in view of the moment of inertia of the club head 3 and the weight of the club head.

The club head 3 in this example is composed of a main body formed as a lost-wax precision casting of a titanium alloy and a face plate formed by forging a titanium alloy. The face plate is welded to the front of the main body. Aside from titanium alloys, various metal materials such as aluminum alloy, pure titanium and stainless steel, composite materials such as FRP and the like may be usable to make the club head 3. Further, aside from casting, various methods may be employed to form the parts of the head.

Figure 3:
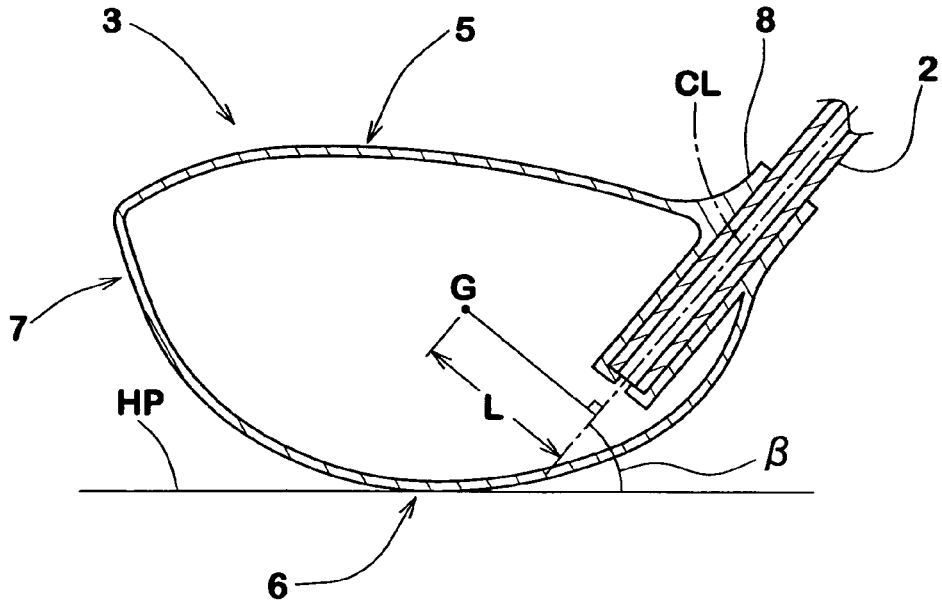
FIG. 3 is a cross sectional view of the club head taken along a line A—A of FIG. 2.

AS shown in FIG. 3, the neck portion 8 is provided with a circular hole 8*a* for inserting the club shaft 2 which extends through a tubular extension towards the inside of the main body from the opening at the top end of the neck portion 8. Incidentally, the center line of the shaft-inserting hole 8*a* can be used instead of the center line CL of the club shaft 2, for example, in order to set up the club head alone at the lie angle lie angle β, to determine the gravity distance L or the like.

If the gravity point distance L is too long, it becomes difficult for the club head to rebound completely. On the other hand, if the gravity point distance L is too short, the club head rebounds too far. Therefore, the gravity point distance L is preferably set in the range of from 33 to 41 mm, more preferably 34 to 41 mm.

The gravity point distance L can be controlled by changing the weight distribution of the club head. For example, increasing the wall thickness or the material thickness on the toe-side may increase the gravity point distance L. On the contrary, increasing of the wall thickness on the heel-side may decrease the gravity point distance L. Aside from the changing of the wall thickness, the gravity point distance L may be changed by using a metal material having a large specific gravity, using a metal material having a small specific gravity, and changing of the shape of the club head. By utilizing these methods alone or in combination, the gravity point distance L is set in the above-mentioned range.

Figure 5:
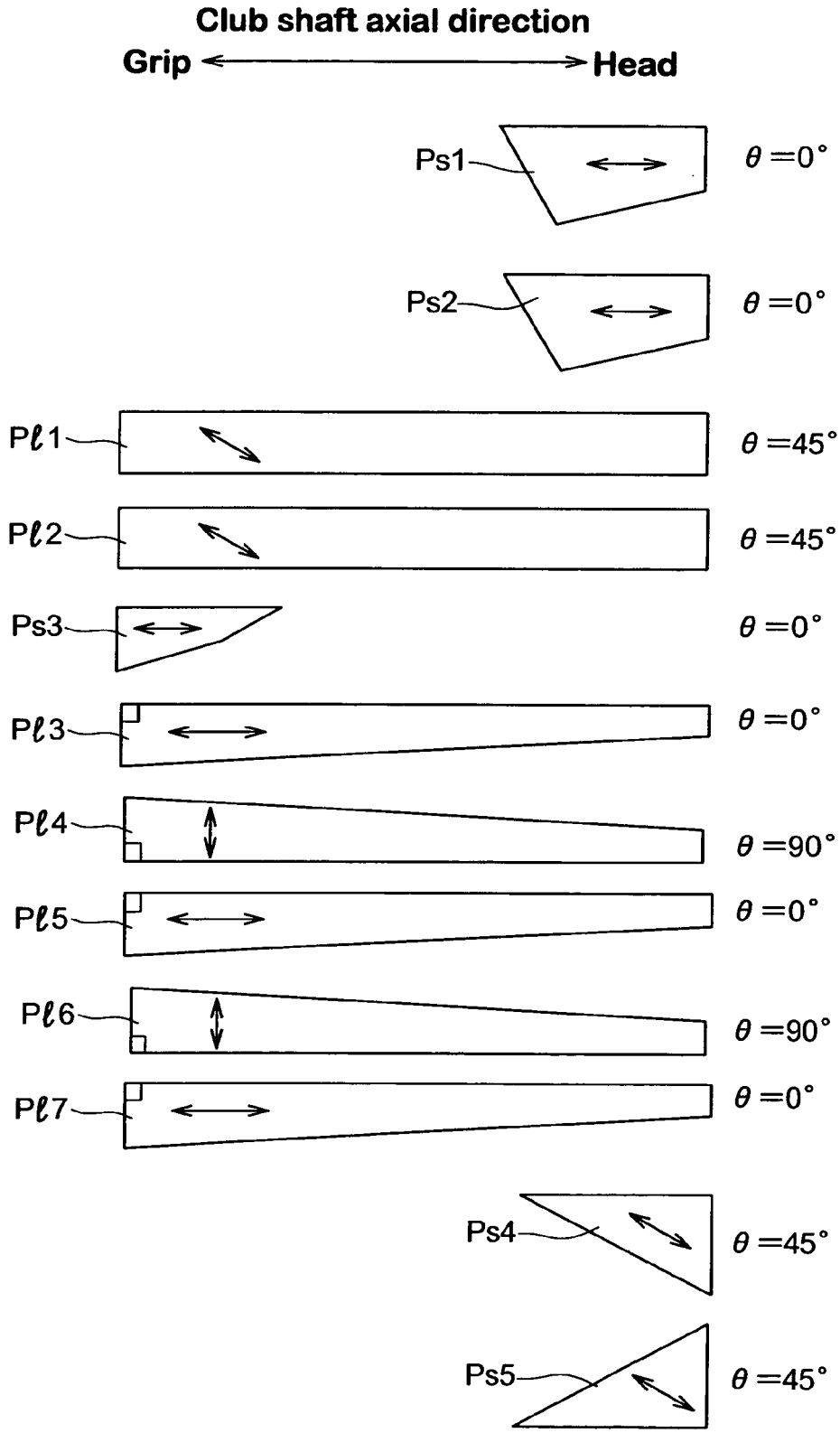
FIG. 5 shows an arrangement of prepreg pieces used in the method for making the golf club shaft.

The shaft 2 in this example is a tubular lamination of prepreg pieces P as shown in FIG. 5. Here, the prepreg is a sheet body of parallel reinforcing fibers impregnated with a heat-hardening resin. AS to the reinforcing fibers, for example, carbon fiber, glass fiber, aramid fiber and metal fibers such as boron, titanium, tungsten, stainless steel, copper and alumina, and the like may be used alone or in combination of two or more kinds of fibers. AS to the heat-hardening resin, for example, an epoxide resin, an unsaturated polyester resin, a phenolic resin, a vinylester resin and the like may be used alone or in a combination of two or more kinds of resins. In any case, fibers whose tensile elastic modulus is in a range of from 10000 to 40000 kgf/sq.mm are preferably used.

The method of making the shaft using such prepreg pieces P is as follows. First, the prepreg pieces P are wound around a mandrel. The wound prepreg pieces P are put into a mold together with the mandrel. Then, the mandrel is removed leaving the prepreg pieces P in the mold and an inflatable bladder is inserted instead. The bladder is inflated so that the prepreg pieces P are pressed onto the mold while applying heat. After the hardening has been done, the bladder and mold are removed.

The prepreg pieces P include long prepreg pieces Pl and relatively small prepreg pieces Ps, wherein the long prepreg piece Pl have a length corresponding to the length of the shaft 2, and the small prepreg pieces Ps are mainly used to adjust or control properties of the shaft.

In this embodiment, as shown in FIG. 5, the long prepreg pieces Pl include first-to-seventh long prepreg pieces Pl1 to Pl7. The small prepreg pieces Ps include first, second, fourth and fifth small prepreg pieces Ps1, Ps2, Ps4 and Ps5 which are wound on the club head side and a third small prepreg piece Ps3 which is wound on the grip side. These prepreg pieces P are wound in the order from top to bottom in the FIG. 5. In the first and second long prepreg pieces Pl1 and Pl2, the reinforce fibers are oriented to one direction at an angle θ of from 40 to 50 degrees with respect to the shaft center line CL. In the third, fifth and seventh long prepreg pieces Pl3, Pl5 and Pl7, the reinforce fibers are oriented to a direction parallel with the shaft center line CL. In the fourth and sixth long prepreg pieces P14 and P16, the reinforce fibers are oriented to a direction perpendicular to the shaft center line CL. In FIG. 5, the oriented direction of the reinforce fibers of each prepreg piece P is indicated by an arrow, and the angle θ is also indicated. AS the club shaft 2 is tapered from the grip 2G to the head 2, over one-half of the long prepreg P1 to P7 are tapered accordingly. The others have almost constant widths.

The above-mentioned torque of the shaft can be adjusted by changing the number of the prepreg pieces P, the shape and/or size of each prepreg piece P especially small prepreg piece Ps, and the orientation angle θ of the reinforce fibers therein. For example, in the first and second small prepreg Ps1 and Ps2, if the angle θ of the reinforce fibers is increased, the torque may be decreased.

As the above-explained laminating method is easy to control the shaft torque, this method is preferably employed. But, it is not necessary to limit the method of making the shaft 2 to this laminating method. For example, the so called "tape wrapping method", "filament winding method" and the like may be also used.

According to the present invention, the gravity point distance L in mm and the torque T in degrees have to satisfy the following conditions (1) and (2), preferably the following conditions (1) and (3).

$$T \geqq 0.143L - 2.79 \quad (1)$$

$$T \leqq 0.286L - 7.14 \quad (2)$$

$$T \leqq 0.286L - 7.89 \quad (3)$$

These conditions (1), (2) and (3) were discovered by the inventor as a result of a large number of hitting tests and experimental manufacture.

Figure 7A:
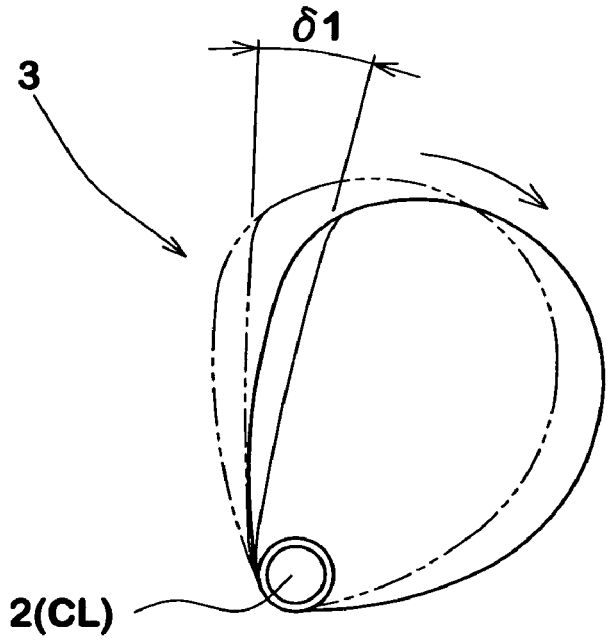
FIGS. 7(*a*) and 7(*b*) are top views for explaining the rotation angle of the club head around the club shaft center line.
Figure 7B:
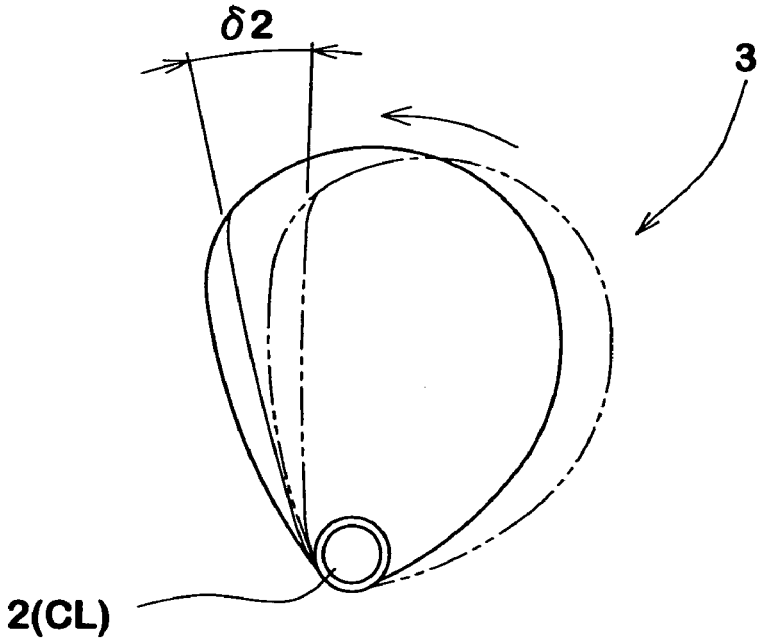
Figure 8:
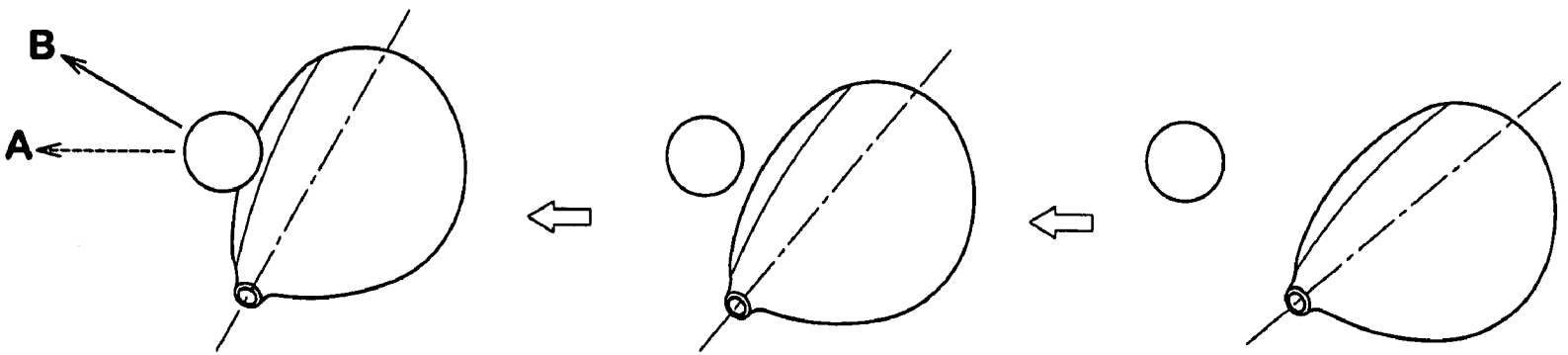
FIG. 8 shows the motion of the club head during a downswing where the club face is open at impact.

If the torque T of the shaft 2 is more than (0.286L−7.14), it becomes difficult for the golfer to square the club face, and the angle δ1 at impact shown in FIG. 7(*a*) tends to increase. Further, as the shaft is liable to be twisted by the reaction of impact, the directional stability is liable to be lost. If the torque T is less than (0.143L−2.79), as the rotation of the club head around the shaft center line during swing becomes decreased, it is difficult to obtain an effective increase in the head speed. Furthermore, the golf club will feel unfavorably stiff, and the club face rebounds too far and the angle 62 at impact, as shown in FIG. 7(*b*), tends to increase.

Comparison Tests

Drivers (#1 wood) having the basic structure shown in FIGS. 1 to 3 and the specifications given in Table 1 were made by way of test and hitting test was conducted.

The prepreg pieces of each shaft had a basically same arrangement as shown in FIG. 5 except that the first and second small prepreg pieces Ps1 and Ps2 were changed in the angle 0 of the reinforce fibers to change the torque.

The gravity point distance was changed by adding a weight made of a metal having a large specific gravity to the club head main body.

Hitting test

Ten golfers whose handicaps ranged from 2 to 11 hit three-piece balls (HI-BRID, Sumitomo Rubber Ind., Ltd.) ten times per club, and the traveling distance (carry+run) and the difference from the target trajectory of the struck balls were measured. Their averaged values are shown in Table 1. Further, the golfers' impressions of the clubs during swing were classified into "stiff", "suitable" and "flexible" and counted. The results are shown in Table 1.

Common Data on Prepreg piece

| Prepreg piece | Elastic modulus (kgf/sq · mm) |
|---|---|
| Pl1 | 40000 |
| Pl2 | 40000 |
| Pl3 | 30000 |
| Pl4 | 30000 |
| Pl5 | 30000 |
| Pl6 | 30000 |
| Pl7 | 30000 |
| Ps1 | 24000 |
| Ps2 | 10000 |
| Ps3 | 40000 |
| Ps4 | 24000 |
| Ps5 | 24000 |

Reinforcing fibers: carbon

Figure 6:
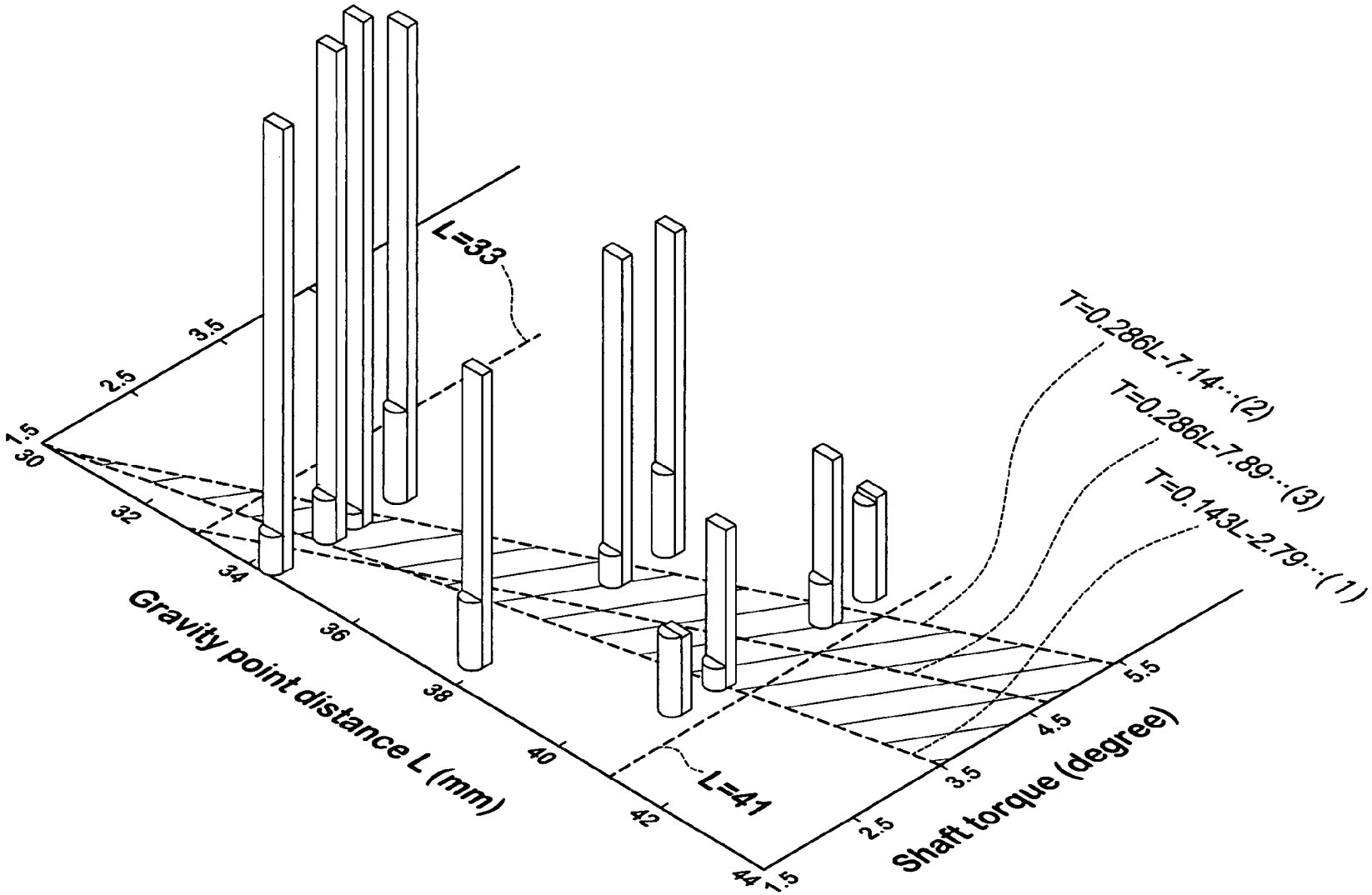
FIG. 6 is a graph showing the shaft torque and gravity point distance of the golf clubs used in the undermentioned hitting test.

The test results are plotted in a graph of distance L vs. torque T shown in FIG. 6 wherein the traveling distance is indicated by a square bar whose height corresponds to a part of the traveling distance over 180 yards, and the difference is indicated by a half-round bar whose height corresponds to the difference. The area satisfying the conditions (1), (2), (3) is provided with hatching.

From the test results, it was confirmed that the golf clubs according to the present invention can be improved in the traveling distance, and the difference from the target trajectory as the result of the improved rebound of the club face.

The invention claimed is:

1. A method of making a golf club, the golf club including a club shaft and a club head attached to the end of the club shaft, the method comprising measuring a torque T in degree of the club shaft,

TABLE 1

| Club | Ex. 1 | Ex. 2 | Ex. 3 | Ex. 4 | Ex. 5 | Ref. 1 | Ref. 2 | Ref. 3 | Ref. 4 | Ref. 5 | Ref. 6 |
|---|---|---|---|---|---|---|---|---|---|---|---|
| Length E (in.) | 45 | 45 | 45 | 45 | 45 | 45 | 45 | 45 | 45 | 45 | 45 |
| Head | | | | | | | | | | | |
| Volume (cc) | 350 | 350 | 350 | 350 | 350 | 350 | 350 | 350 | 350 | 350 | 350 |
| Material | Main body: Ti-6 Al-4 V, Face plate: Ti-4.5 Al-3 V-2 Fe-2 Mo | | | | | | | | | | |
| Hook angle (deg) | 3 | 3 | 3 | 3 | 3 | 3 | 3 | 3 | 3 | 3 | 3 |
| Lie angle (deg) | 56 | 56 | 56 | 56 | 56 | 56 | 56 | 56 | 56 | 56 | 56 |
| Loft angle (deg) | 9 | 9 | 10 | 11 | 11 | 9 | 9 | 10 | 10 | 11 | 11 |
| Gravity point distance L (mm) | 34.3 | 34.3 | 37.8 | 40.5 | 40.5 | 34.3 | 34.3 | 37.8 | 37.8 | 40.5 | 40.5 |
| Club shaft | | | | | | | | | | | |
| Mass (g) | 56.5 | 56.5 | 56.5 | 56.5 | 56.5 | 56.5 | 56.5 | 56.5 | 56.5 | 56.5 | 56.5 |
| Flex | Normal: 114 mm, Inverse: 107 mm | | | | | | | | | | |
| Shaft torque T (deg.) | 2.2 | 2.5 | 3.4 | 3 | 4.2 | 3 | 1.6 | 4 | 1.8 | 4.7 | 2.2 |
| Conditions* | | | | | | | | | | | |
| (1) T ≧ 0.143 L−2.79 | S | S | S | S | S | S | N | S | N | S | N |
| (2) T ≧ 0.286 L−7.14 | S | S | S | S | S | N | S | N | S | N | S |
| (3) T ≧ 0.286 L−7.89 | S | S | S | N | S | S | N | S | N | S | N |
| Test results | | | | | | | | | | | |
| Head speed (m/s) | 51.2 | 51.4 | 43.8 | 39.5 | 39.4 | 51.5 | 51 | 44 | 42.5 | 39.6 | 38.8 |
| Traveling distance (yard) | 252.3 | 254.4 | 228 | 203.3 | 204.5 | 249.8 | 245.3 | 227.4 | 223 | 195.3 | 191.1 |
| Difference (yard) | 2.3 | 6.5 | 4.8 | 3.2 | 6.5 | 13.3 | 5.7 | 12.2 | 9.8 | 14.5 | 11.4 |
| Impression of Shaft | | | | | | | | | | | |
| Stiff (person) | 2 | 1 | 1 | 2 | 1 | 0 | 7 | 0 | 9 | 0 | 9 |
| Suitable (person) | 8 | 9 | 9 | 8 | 9 | 2 | 3 | 3 | 1 | 1 | 1 |
| Flexible (person) | 0 | 0 | 0 | 0 | 0 | 8 | 0 | 7 | 0 | 9 | 0 |

*S: Satisfied, N: Not satisfied measuring a gravity point distance L in mm between the gravity point of the club head and the center line of the club shaft, determining whether the torque T and gravity point distance L satisfy the following conditions (1) and (2)

$$T \geqq 0.143L - 2.79 \text{ and} \quad (1)$$

$$T \leqq 0.286L - 7.14, \text{ and} \quad (2)$$

assembling the club shaft and club head when their torque T and gravity point distance L satisfy the conditions (1) and (2).

2. The method of making a golf club according to claim 1, which further comprises making a club head which has a head volume in a range of not less than 250 cc and the gravity point distance L in a range of from 33 to 41 mm.

3. The method of making a golf club according to claim 1, which further comprises making a club shaft which provides a club length in a range of from 43 to 48 inches.

4. The method of claim 1, wherein the torque T and the gravity point distance L satisfy said condition (1) and the following condition (3)

(3) $T \leqq 0.286L - 7.89$.

5. A method of making a golf club, the golf club including a club shaft and a club head attached to the end of the club shaft, the method comprising providing a torque T in degree of the club shaft, providing a gravity point distance L in mm between the gravity point of the club head and the center line of the club shaft, determining whether the obtained torque T and gravity point distance L satisfy the following conditions (1) and (2)

$$T \geqq 0.143L - 2.79 \text{ and} \quad (1)$$

$$T \leqq 0.286L - 7.14, \text{ and} \quad (2)$$

assembling the club shaft and club head when their torque T and gravity point distance L satisfy the conditions (1) and (2).

6. A method of making a wood-type golf club including a club shaft and a club head attached to the end of the club shaft, comprising determining a torque T in degree of the club shaft and a gravity point distance L in mm between the gravity point of the club head and the center line of the club shaft by determining whether the torque T and gravity point distance L satisfy the following conditions (1) and (2) so that the following conditions (1) and (2) are satisfied $$T \geqq 0.143L - 2.79 \quad (1)$$

$$T \leqq 0.286L - 7.14, \text{ and} \quad (2)$$

combining the club shaft and the club head which have the determined torque T and gravity point distance L.

7. A method of designing a wood-type golf club including a club shaft and a club head attached to the end of the club shaft, comprising providing a torque T in degree of the club shaft, and determining a gravity point distance L in mm between the gravity point of the club head and the center line of the club shaft by determining whether the torque T and gravity point distance L satisfy the following conditions (1) and (2) so as to satisfy the following conditions (1) and (2)

$$T \geqq 0.143L - 2.79 \quad (1)$$

$$T \leqq 0.286L - 7.14. \quad (2)$$

8. A method of designing a wood-type golf club including a club shaft and a club head attached to the end of the club shaft, comprising providing a gravity point distance L in mm between the gravity point of the club head and the center line of the club shaft, and determining a torque T in degree of the club shaft by determining whether the torque T and gravity point distance L satisfy the following conditions (1) and (2) so as to satisfy the following conditions (1) and (2)

$$T \geqq 0.143L - 2.79 \quad (1)$$

$$T \leqq 0.286L - 7.14. \quad (2)$$

9. A method for improving the rebound of a wood-type golf club including a club shaft and a club head attached to the end of the club shaft, comprising determining a torque T in degree of the club shaft and a gravity point distance L in mm between the gravity point of the club head and the center line of the club shaft by determining whether the torque T and the gravity point distance L satisfy the following conditions (1) and (2) so that the following conditions (1) and (2) are satisfied $$T \geqq 0.143L - 2.79 \quad (1)$$

$$T \leqq 0.286L - 7.14, \text{ and} \quad (3)$$

combining the club shaft and the club head which have the determined torque T and gravity point distance L.

* * * * *